US005159718A

United States Patent [19]

Moyer

[11] Patent Number: 5,159,718

[45] Date of Patent: * Nov. 3, 1992

[54] SAFETY HUNTER'S GARMENT

[76] Inventor: Randall S. Moyer, RD #1, Box 328, Bellefonte, Pa. 16823

[ * ] Notice: The portion of the term of this patent subsequent to Feb. 3, 2008 has been disclaimed.

[21] Appl. No.: 261,882

[22] Filed: Oct. 25, 1988

[51] Int. Cl.[5] ..... A41D 1/08

[52] U.S. Cl. ..... 2/69; 2/79; 2/115; 2/227; 2/93; 2/94; 2/102; 2/172; 2/DIG. 2; 2/DIG. 6; 2/DIG. 11

[58] Field of Search ..... 2/79, 69, 115, 1, 227, 2/93, 94, 102, 172, DIG. 6, DIG. 2, DIG. 11

[56] References Cited

U.S. PATENT DOCUMENTS

| | | | |
|---|---|---|---|
| 1,773,442 | 8/1930 | Speh | 2/DIG. 2 |
| 2,367,442 | 1/1945 | Snider | 2/115 |
| 3,381,307 | 5/1968 | Shingler | 2/94 |
| 3,849,804 | 11/1974 | Rakow | 2/115 X |
| 4,277,848 | 7/1981 | Boehland | 2/115 |
| 4,453,274 | 6/1984 | Allen | 2/115 X |
| 4,513,451 | 4/1985 | Brown | 2/93 X |
| 4,656,065 | 4/1987 | Yacovella | 2/1 |
| 4,710,981 | 12/1987 | Sanchez | 2/115 |
| 4,805,241 | 2/1989 | Faccini | 2/102 |
| 4,817,210 | 4/1989 | Aldridge et al. | 2/93 X |

FOREIGN PATENT DOCUMENTS

| | | | |
|---|---|---|---|
| 2081069 | 2/1982 | United Kingdom | 2/DIG. 12 |
| 2164541 | 3/1986 | United Kingdom | 2/93 |

*Primary Examiner*—Werner H. Schroeder
*Assistant Examiner*—Gloria Hale
*Attorney, Agent, or Firm*—Lalos & Keegan

[57] ABSTRACT

A safety hunter's garment that permits the selective interchangeability of camouflage on the garment to a plurality of bands of Hunter's orange, the blazing fluorescent orange by simply reversing the bands to expose or cover the selected mode. An arrangement of a plurality of fasteners on a band of opposed materials of camouflage and Hunter's orange enables this exchange.

6 Claims, 3 Drawing Sheets

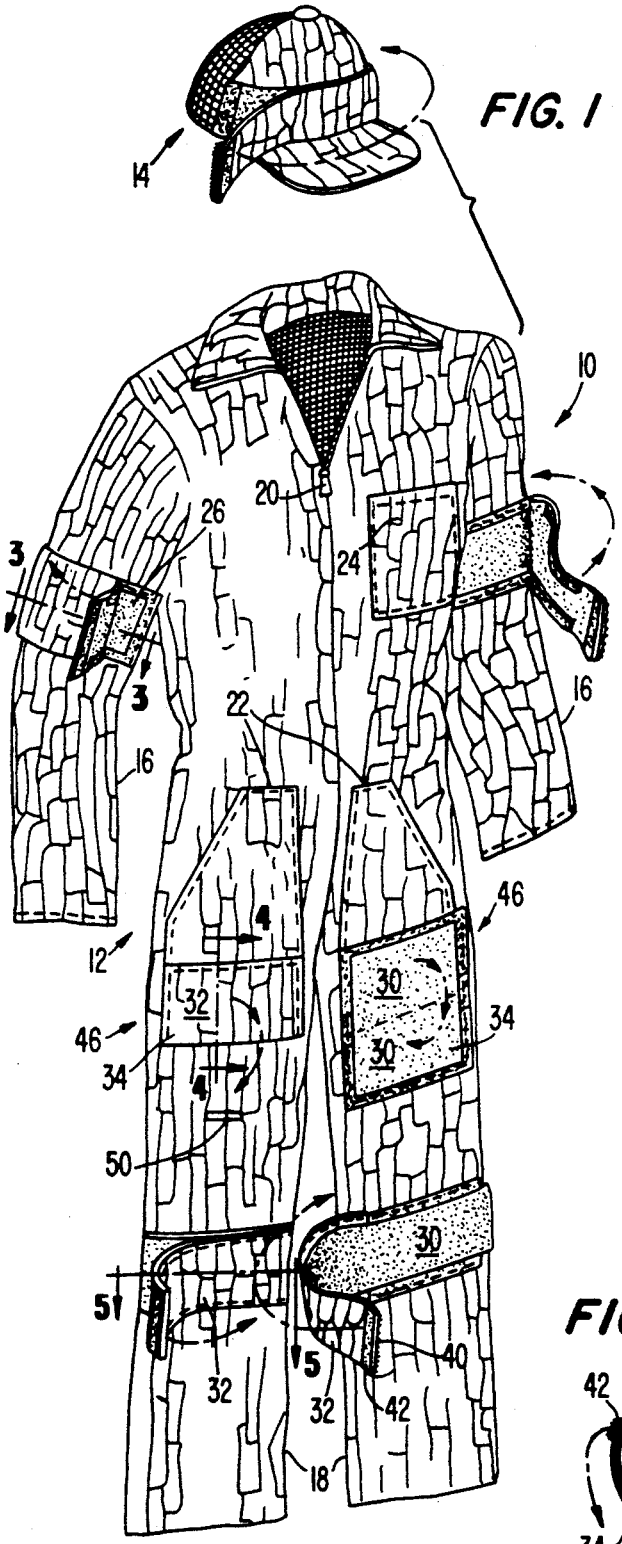
FIG. 1
FIG. 2
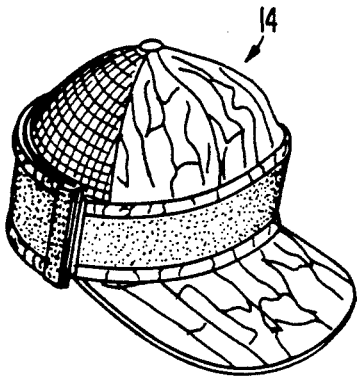
FIG. 3
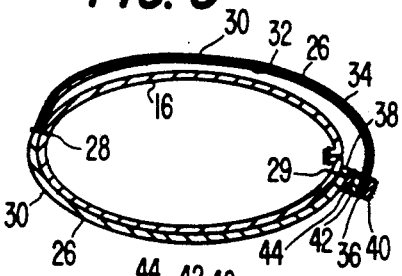
FIG. 4
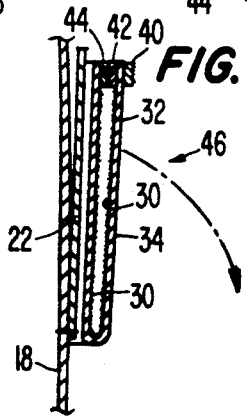
FIG. 5
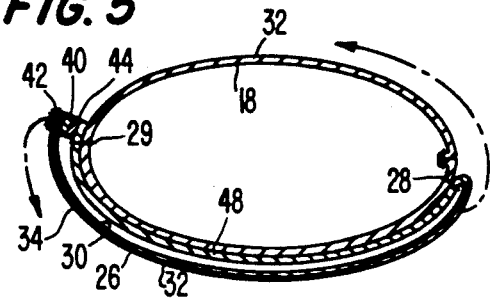

SAFETY HUNTER'S GARMENT

BACKGROUND OF THE INVENTION

This invention relates to safety hunting garments to be worn by hunters while hunting or in a hunting environment. More particularly the present invention relates to a hunter's garment whether it be a hat, jacket, trousers or coveralls that provide the hunter with a high degree of safety, efficiency and convenience without interfering in any undesirable manner with the hunting technique or the hunter's ability to engage in hunting activities.

This invention relates to safety garments for hunters when hunting any animal species so as to provide for their safety because it is recognized that more and more hunters are entering the field of hunting for any species. This massive influx of new and possibly inexperienced hunters causes more injuries due perhaps to mistaken perceptions by the hunters that cause the hunters to wound and kill fellow hunters or others in range of their shot.

The safety problem is particularly of concern amongst turkey hunters primarily for the reason that it is believed by many, if not most all turkey hunters, that turkeys have such incredible eyesight that is so acute as to be able to detect various colors, and particularly would be capable of detecting the presence on any hunter of the typical fluorescent orange, Hunter's orange, coloring used by hunters to make their presence known to other hunters. Most turkey hunters therefore believe, whether it is true or not, that the wearing of the Hunter's orange would be easily detected by the turkey and would chase the turkey out of shot range.

Whatever the reason, the number of accidents amongst turkey hunters has increased to such a great extent in the last two decades that it has come to the attention of government officials particularly at the state level. To date, there are no requirements for turkey hunters to wear Hunter's orange during all of the turkey seasons but the problem is becoming more serious in view of the number influx of turkey hunters coming into the field, which will produce only more accidents given the current clothing worn by the hunters.

Mistaken identity that causes the hunter to fire is given as the primary cause of all accidents during turkey hunting. The hunter causing the accident typically shoots upon hearing a sound without waiting a sufficient time to identify the target. It is obvious to hunters that to avoid such accidents, they must be more patient and more careful while exercising more discipline in order to make certain that the target at which they are firing is a valid and legal target.

It also would seem to be an obvious solution for the hunter to aid himself in avoiding being an unintentional target by using the Hunter's orange liberally on his body garments so that the shooter would be able to identify his intended target as human. However, such liberal use of the Hunter's orange, in the mind of many hunters, interferes with effective hunting by giving advance warning of the hunter's presence to the turkey. On the contrary, the hunter typically believes that it is necessary for him to camouflage his presence by the use of carefully chosen camouflage clothing to cover all exposed parts and to use the Hunter's orange only when moving to a new position. Such changes from the Hunter's orange to camouflage or vice versa requires time and is often overlooked or disregarded by the hunter leaving open the possibility for an accident to occur.

In the past, there were hunting garments that attempted to provide some safety features. Included in this group would be, for instance, the Shingler U.S. Pat. No. 3,381,307 that discloses the utilization of a flap that may be concealed or exposed on a hunting jacket. This construction of the jacket would require the jacket or other garment to be removed so that the changes can be made to expose or conceal the flap when positioned in the rear of the garment and thus would not be a suitable arrangement.

Another concept that had been used frequently is disclosed in the Speh Patent U.S. Pat. No. 1,773,442 wherein a reversible hunting coat is disclosed having one side with camouflage and an inner coat lining with a red or other more highly visible material. Again such a coat requires removal for effective use.

OBJECTS OF THE PRESENT INVENTION

It is therefore the principal object of the present invention to avoid the unsafe practices of the past and to allow the hunter to conveniently and easily make changes in the appearance of the hunter's garment so as to be both safe when in motion and yet have the opportunity to provide a camouflaged look when in the hunting position.

SUMMARY OF THE INVENTION

The present invention utilizes a body forming garment that may be in the form of a hat, jacket or trousers in which there is a first material having an external appearance of low visibility such as camouflage and a second material of high visibility such as the Hunter's orange. A second area of material for obscuring the view of the high visibility material is secured to the body adjacent the first area of high visibility material. The second area of the material has an out side and an under side being selectively externally visible with at least on side of the second area being formed from low visibility material. The second area of material at its distal end is provided with fastening means on the out side and the under side while a complementary third fastening means is secured to the garment to releasably secure another of said fastening means so that the first area of high visibility can be selectively covered or augmented by the second area of material.

IN THE DRAWINGS

FIG. 1 is a composite partly exposed view of the garments of the present invention including a hat and coveralls and illustrating the various locations for positioning of the fluorescent orange safety colors.

FIG. 2 is a perspective view of the hat embodying the fluorescent orange band encircling the crown of the hat.

FIG. 3 is a cross-section taken along lines 3—3 of FIG. 1 and illustrating one embodiment of the positioning of the safety fluorescent orange band illustrating the high visibility fluorescent mode.

FIG. 4 is a cross-sectional view partly broken away taken along lines 4—4 of FIG. 1.

FIG. 5 is a cross-sectional view taken along lines 5—5 of FIG. 1 illustrating the camouflage mode.

DETAILED DESCRIPTION OF THE INVENTION

Figure 6:
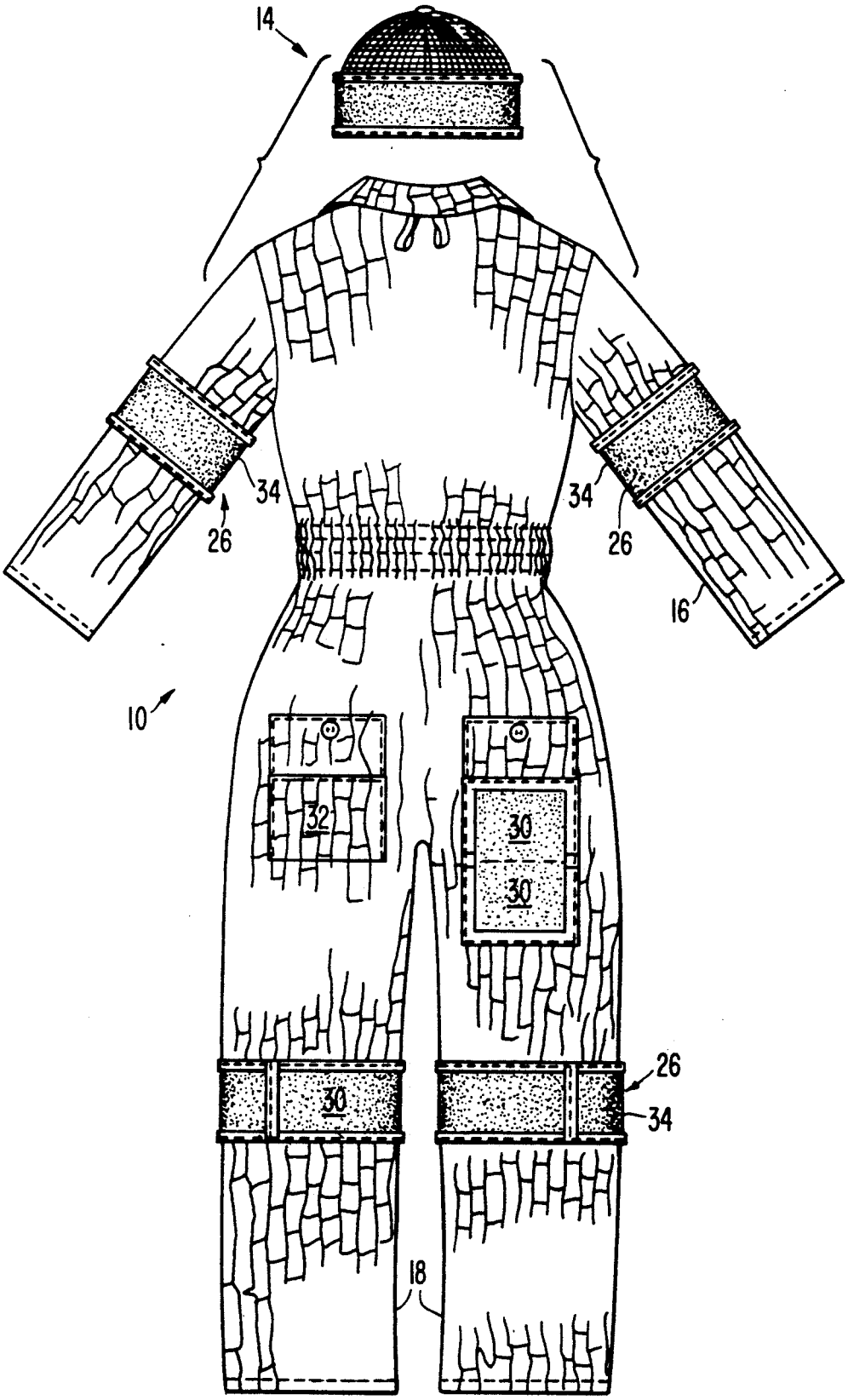
FIG. 6 is a view of the rear of the overalls and hat of FIG. 1 illustrating the invention in the high visibility fluorescent orange mode.

In FIGS. 1 and 6, there is illustrated the ensemble forming the safety hunter's garment of the present invention and denominated by the FIG. 10 to show generally the ensemble. As shown, the hunter's garment 10 may be in the form of overalls 12 having a unitary jacket and trousers as shown in FIG. 1 as well as a hat 14. Preferably, the basic color of the garment is a low visibility color, such as camouflage. Of course, the overalls 12 may be made separate into an individual jacket and an individual pair of trousers, not shown. The construction of the overalls 12 is conventional in the make up of the sleeve 16, 16 and the trouser leg 18, 18 with a conventional zipper front 20 and conventional pockets 22, 22 and the trouser legs and breast pocket 24 as shown quite clearly in FIG. 1.

On each of the sleeves 16, 16 and trouser legs 18, 18 as well as around the hat 14 there is a structure that is the essence of the present invention.

As shown in FIGS. 3, 5 the principal embodiment of the invention is shown as a band area, about 4 inches wide more or less and secured about half-way around the sleeve by stitching as at 28. The fluorescent orange material can be any suitable garment material preferably waterproof, can be cotton or synthetic blend. The type of material forming the band 26 is not important merely that the fluorescent orange color be exposed selectively when desired. Forming the same or a different band or area 26 encircling the sleeve 16 or the trouser leg 18 in direction opposite to the direction of the band portion 26 previously described is shown at FIG. 3 on the top of the Figure or at FIG. 5 on the base of the Figure at 26 that is similarly of the same width as previously described and has an side 30 and an side 32 that are mutually opposed materials of respectively high visibility fluorescent orange and low visibility camouflage-type coloring at 32. The band 26 may be the composite throughout its entire encirclement of the sleeve and trouser leg or merely the portion not secured to the trouser or sleeve at stitching 28 and 29 to form a free flap-like area 34. The free flap-like area 34 that may form a continuation of the band or area 26 therefore is two-sided having the side 30 in fluorescent orange and the side 32 in a camouflage-type color. At the distal end 36 as compared to the proximate end of band 26 as shown at 38 there is positioned adjacent the distal end fasteners 40 and 42 on respectively the high visibility fluorescent orange side 30 and the side of the camouflage-type coloring 32 which may be the conventional velcro-type fasteners either of the hook or loop variety but in the embodiment of FIGS. 3 and 5 both the fasteners 40 and 42 should be either of the hook or loop variety so as to be securely fastened when attached to the complementary fastener 44 on the proximate end or adjacent such end of the band 26 that is secured to the garment at 29. As shown in FIG. 3 the flap 34 is securely fastened such that the entire surround for the sleeve 16 as shown in FIG. 3 exhibits the fluorescent orange color. The construction is identical for the 14 hat and sleeve and trouser legs 16 and 18, respectively.

In the high visibility mode as shown in FIG. 3 with the fluorescent orange blazing in color the hunter is more confident in moving without being an unwarranted target by a fellow hunter. The blazing fluorescent orange will be displayed about both sleeves, both trouser legs and the hat, as well as patch 46 to be described subsequently.

When the hunter decides to assume the hunter's position and therefore wants to be more concealed from the turkey or other prey, the present invention enables the hunter to selectively change the garment from the high visibility mode described to the low visibility mode of all camouflage to match the camouflage color of the majority of the overalls 12 and hat 14.

The change from the high visibility blazing fluorescent orange mode to the camouflage-type concealment mode is best shown in FIG. 5 wherein the positioning of the flap 34 is reversed pivoting about the stitching 28 after being released from the securing means 44 to now expose the previously covered side camouflage material 32 as the out side and the fluorescent orange material 30 previously on the visible side now being the under side as shown at 30 of FIG. 5 to conceal the fluorescent orange coloring shown for convenience at 48 that is the same as the exposed portion 30 as shown at the lower portion of FIG. 3.

To secure the flap 34 from the position of FIG. 3, the reversal takes place as shown in FIG. 5 so that the velcro fastener 42 now is operative with the complementary fastener 44, previously described in FIG. 3 as being present at the proximal end of the band 26. As shown in FIG. 5, therefore, whether for the hat 14, the sleeve 16, or the leg 18, the fluorescent orange band at 30 and at 48 are obscured and only the camouflage coloring at 32, which is the same as the basic coloring of the hat, sleeve and leg can be seen at 32 in FIG. 5. This simple operation will complete the concealment of the hunter in the safety hunter's garment of the present invention.

The patch 46 as best shown in FIG. 1 and in FIG. 4 is similar to that previously described where the side for camouflage coloring is shown at 32 on the flap 34, which is similar to the band 26. The equivalent to the side of fluorescent orange, as shown in FIG. 3, is in FIG. 4 shown at 30 also and it is in the position in FIG. 4 covered and obscured from view in the camouflage mode. However, in the high visibility mode shown in FIG. 1 on the trouser leg 18 on the righthand side of FIG. 1, the high visibility area of fluorescent orange is shown at 30, which similarly faces a high visibility area 30 that is in confronting relationship and may be shown also at 30 on the righthand side of the leg of FIG. 1. The fastening means of FIG. 4 is precisely the same as described in FIG. 3, except that a fastener is shown at 50 on the lefthand side of FIG. 1 on the leg 18. A similar fastener is positioned below the flap 34 on the righthand leg shown in FIG. 1.

In the embodiment of the invention shown in FIG. 4, the flap 34 is simply raised or lowered in accordance with whether the hunter wishes to make visible the fluorescent orange material of high visibility as shown at the righthand side of leg of FIG. 1 or have the camouflage colored fluorescent orange shown in the lefthand side of FIG. 1 and is shown in FIG. 4.

Figure 3A:
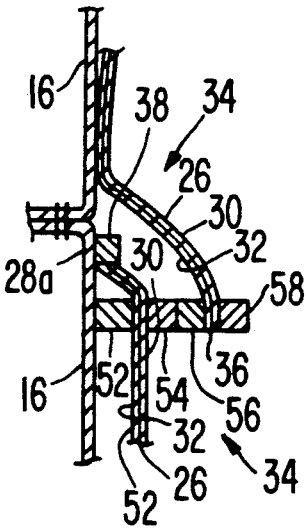
FIG. 3A is a view partly broken away taken along lines 3—3 of FIG. 1 illustrating a modification of the present invention and exhibiting also the fluorescent orange side of a visibility area.
Figure 3B:
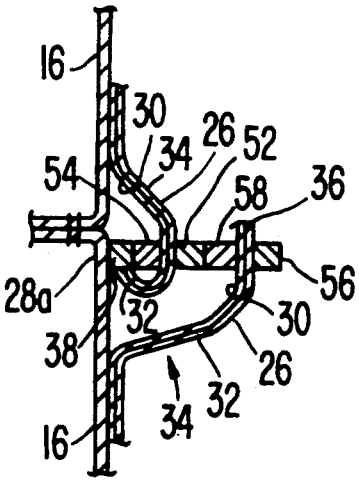
FIG. 3B is a cross-sectional view partly broken away taken along line 3—3 of FIG. 1 illustrating the same modification of FIG. 3A showing the reversal of the visibility area to show only the camouflage mode.

There is an additional embodiment of the present invention illustrated in FIGS. 3A and 3B.

In the embodiment illustrated in FIGS. 3A and 3B, the structure is quite similar to that illustrated in FIG. 3 and FIG. 5 and the cross-sectional view 3—3 of FIG. 1, except that there is no stitching or securing means equivalent to that shown at 28, however, there is still stitching or other securing means to secure the band 34 to the sleeve 16 as shown at 28*a* that secures the flap 34 or band 26 to the sleeve 16. This arrangement is similar to the effect of stitching 29 of FIGS. 3 and 5. It should also be understood that in the FIGS. 3A and 3B, the embodiment illustrates only the securing of the fluorescent orange band 26 to the sleeve 16 whereas the same structure is to be used for the trouser leg 18 and hat 14.

As shown in FIG. 3A the securing means 28*a* is secured to the proximal end 38 to which at an location close and adjacent to the proximal end 38 there are attached velcro fasteners 52 and 54, which may be of the loop type each. Each of these fasteners 52 and 54 is on an opposite side of the band 26. The fasteners 52 and 54 are respectively secured to the side of the camouflage material 32 while the fastener 54 is secured to the side of the fluorescent orange surface 30.

At the distal end 36 of the band 26 there are complementary velcro fasteners preferably of the hook type shown at 56 and 58 which are at the distal end 36 and are on opposite sides of the flap 26, fastener 56 being on the side of the camouflage material while the fastener 58 is on the fluorescent orange side.

Thus, as shown in FIG. 1 the blazing fluorescent orange is exposed on the hunter's garment by encircling the band 36 in the direction as shown. When it is desired to show the camouflage color and obscure the fluorescent orange, the band 26 is reversed as shown in FIG. 3B and wrapped in the reverse manner so that the side with the camouflage material 32 exposed. In this manner fastener 54 previously operative with fastener 56 on the distal end 36 of the band 26 in accordance with the showing in FIG. 3A is now covered and obscured and becomes inoperative while fastener 52, inoperative in the fluorescent orange mode of FIG. 3A, now in the camouflage mode of FIG. 3B is operative to secure the distal end 36 with the hook fastener 58. While hook fastener 56 previously operative in the fluorescent orange mode of FIG. 3A now becomes inoperative as only the camouflage material of the band 26 is shown in the camouflage mode of FIG. 3B.

It should be quite apparent that the description of the present invention whether in the first embodiment described or in the second embodiment meets the objectives of the invention and provides the hunter with the ability to selectively and easily and very efficiently change from the safety hunter's fluorescent orange mode while the hunter is in motion to the camouflage mode simply by reversing or opening the flaps in the desired manner as described.

In accordance with the foregoing, it is respectfully believed by the inventor that the invention should be limited solely by the appended claims in which:

I claim:

1. A hunter's garment providing selectably high visibility for safety and lower visibility for hunting, comprising:

a body portion forming said garment;

said body portion being shaped to conform to a portion of a human figure;

said body portion being formed from a first material having an external appearance of low visibility;

a band area secured to said body portion and selectively encircling said portion of said human figure, said band area having a first area and a second area;

said first area being formed from a second material of high visibility, said first area having a first and second end and being secured to said body portion at said first and second ends, said first area having a first fastening means formed on said first end;

said second area having an outer side and an inner side and a first end and a second end, said inner side being formed from said second high visibility material, said outer side being formed from said first low visibility material, said first end of said second area being integral with said second end of said first area, said second area being secured to said body portion at said first end, said second end of said second area having a second and third fastening means on each of said inner and outer sides thereof respectively;

wherein when said second fastening means is secured to said first fastening means, said first area is obscured by said second area and said outer side of said second area is exposed and all areas of said high visibility material are obscured;

and wherein when said third fastening means is secured to said first fastening means, said inner area of said second area and said first area are exposed and said portion of said human figure is encircled by said second high visibility material.

2. The hunter's garment of claim 1, including, said second material being of a fluorescent orange color for high visibility.

3. The hunter's garment of claim 1, including, said first material being of a camouflage-type color of low visibility.

4. The hunter's garment of claim 1, including, said first, second and third fastening means being hook and pile type fasteners.

5. The hunter's garment of claim 1, wherein said first material is primarily of shades of green and brown.

6. The hunter's garment of claim 3, wherein said camouflage-type color is primarily shades of green and brown.

* * * * *